US007967403B2

(12) United States Patent
Kim

(10) Patent No.: US 7,967,403 B2
(45) Date of Patent: Jun. 28, 2011

(54) HOME BAR FOR REFRIGERATOR AND ASSEMBLY METHOD THEREOF

(75) Inventor: Ung Su Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 472 days.

(21) Appl. No.: 12/134,068

(22) Filed: Jun. 5, 2008

(65) Prior Publication Data

US 2008/0303400 A1 Dec. 11, 2008

(30) Foreign Application Priority Data

Jun. 5, 2007 (KR) ..... 10-2007-0054747

(51) Int. Cl.
*A47B 96/04* (2006.01)

(52) U.S. Cl. ..... 312/405; 312/296; 312/292

(58) Field of Classification Search ..... 312/404, 312/405, 405.1, 296, 292; 49/489.1, 492.1, 49/498.1, 493.1; 62/265, 449
See application file for complete search history.

(56) References Cited

U.S. PATENT DOCUMENTS 4,538,380 A * 9/1985 Colliander ..... 49/489.1
4,586,347 A * 5/1986 McCarty ..... 62/265
4,822,117 A * 4/1989 Boston, Jr. ..... 312/296
5,174,065 A * 12/1992 Schlicht ..... 49/489.1
5,289,657 A * 3/1994 Kiel ..... 49/478.1
6,116,615 A * 9/2000 Trehan ..... 49/498.1
6,125,591 A * 10/2000 Schmidhuber et al. ..... 49/489.1
6,158,171 A * 12/2000 Kellogg et al. ..... 49/489.1
6,530,190 B2 * 3/2003 Conachen ..... 49/489.1
6,820,952 B2 * 11/2004 Austin et al. ..... 312/326
7,086,201 B2 * 8/2006 Struyven et al. ..... 49/490.1
7,360,278 B2 * 4/2008 Jang et al. ..... 16/357
2001/0027622 A1 * 10/2001 Mine et al. ..... 49/498.1

* cited by examiner

*Primary Examiner* — Hanh V Tran
(74) *Attorney, Agent, or Firm* — Birch, Stewart, Kolasch & Birch, LLP

(57) ABSTRACT

Provided is a home bar for a refrigerator that reduces assembly costs of a gasket and prevents cooling air leakage by improving a gasket structure of a home bar. The home bar includes an opening, a home-bar frame, a home-bar door, and a gasket. The opening is formed on a refrigerator door. The home-bar frame forms an edge portion of the opening. The home-bar door is rotatably coupled to one end of the home-bar frame. The gasket is coupled to the home-bar frame and surrounds both a front surface and a rear surface of the home-bar frame. The home bar can be easily sealed by preventing cooling air leakage from a storing portion of the home bar. In addition, assembly costs of a gasket and a home-bar frame can be reduced, thereby reducing a fabrication cost of a refrigerator.

23 Claims, 7 Drawing Sheets

HOME BAR FOR REFRIGERATOR AND ASSEMBLY METHOD THEREOF

CROSS-REFERENCE TO RELATED APPLICATIONS

The present application claims priority under 35 U.S.C. 119 and 35 U.S.C. 365 to Korean Patent Application No. 10-2007-0054747 filed on Jun. 5, 2007, which is hereby incorporated by reference in its entirety.

BACKGROUND

The present embodiments relate to a home bar for a refrigerator, and more particularly, to a home bar for a refrigerator, which easily seals a home bar frame and a door liner by improving a gasket structure, thereby minimizing cooling air leakage from the home bar.

A refrigerator includes a body for storing food in a frozen state or a chilled state. The body includes a plurality of storage rooms for storing the food. One surface of each storing room is open to allow a user to take the food stored therein.

A door is provided at one side of the storage room and is rotatably coupled to the body. The storage room may be opened and closed using the door.

A recently manufactured refrigerator further includes a home bar mounted at a portion of the door in order to prevent excessive cooling air leakage caused by opening and closing of a door. The home bar allows drink or food stored in a refrigerator compartment to be taken out without having to open the refrigerator door.

A related art home bar includes a home-bar door for selectively shielding an opening formed on a front surface of a refrigerator door. The related art home bar further includes a home-bar frame formed in the refrigerator door. The home-bar frame is brought into tight contact with the home-bar door when the home-bar door is closed.

The home bar-door has a shape corresponding to that of the home-bar frame. Therefore, when the opening is shielded by the home-bar door, the home-bar door may be in tight contact with the home-bar frame.

A door liner, which forms an inner surface of the refrigerator door, is connected with the home-bar frame. An insulating layer is formed between the door liner and the home bar-frame to prevent heat transfer through the home bar.

A gasket is mounted to prevent a gap from being generated between the door liner and the home-bar frame and to prevent moisture intrusion into the insulating layer between the door liner and the home-bar frame.

The gasket includes a front gasket bringing the home-bar door into contact with the home-bar frame and a rear gasket preventing heat transfer between the door liner and the home-bar frame.

In a related art assembly method of a home bar, the front gasket and the rear gasket are separately coupled to a front surface and a rear surface of the home-bar frame.

However, the related art assembly method has following limitations.

Since the front gasket and the rear gasket are separately coupled to both surfaces of the home-bar frame and pressed, the same process is performed twice, resulting in a complicated process and high cost.

In addition, since the gasket is not mounted in a connecting portion between the front and rear gaskets, that is, an inner circumferential surface of the home-bar frame, cooling air may leak through the inner circumferential surface of the home-bar frame.

SUMMARY

Embodiments provide minimizing cooling air leakage through a home bar by improving a structure of a gasket coupled to a home-bar frame.

Embodiments also provide reducing costs for assembly and pressing of a gasket by applying an improved gasket structure to fabrication and installation of a home bar of a refrigerator.

In one embodiment, a home bar for a refrigerator includes: an opening formed on a refrigerator door; a home-bar frame forming an edge portion of the opening; a home-bar door rotatably coupled to one end of the home-bar frame; and a gasket coupled to the home-bar frame and surrounding both a front surface and a rear surface of the home-bar frame.

In another embodiment, a home bar for a refrigerator includes: a body storing cooling air; a refrigerator door rotatably coupled to the body; a home-bar frame provided in the refrigerator door to form an opening; a gasket coupled to the home-bar frame to prevent cooling air leakage from the body; and a home-bar door selectively shielding the opening and being in contact with the gasket. The gasket includes: an outer portion provided on a front surface of the home-bar frame; an inner portion provided on a rear surface of the home-bar frame; and a connecting portion brought into contact with an inner surface of the home-bar frame.

In a further embodiment, a home bar for a refrigerator includes: an opening formed on a refrigerator door; a home-bar frame forming an edge portion of the opening; a home-bar door selectively shielding the opening; and a gasket comprising a plurality of coupling portions coupled to the home-bar frame. A plurality of insert portions are formed in the home-bar frame, the coupling portions are inserted into the insert portions at front and rear sides, and the plurality of coupling portions are integrally formed.

In a still other embodiment, assembly method of a home bar for a refrigerator, the method includes: coupling a connecting portion of a gasket, which is in contact with an inner surface of a home-bar frame, to an outer portion of the gasket coupled to a front side of the home-bar frame; inserting the outer portion into an outer insert portion of the home-bar frame; inserting an inner portion of the gasket, which is coupled to a rear side of the home-bar frame, into an inner insert portion of the home-bar frame; and seating a refrigerator door liner on one side of the inner portion.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

Figure 1:
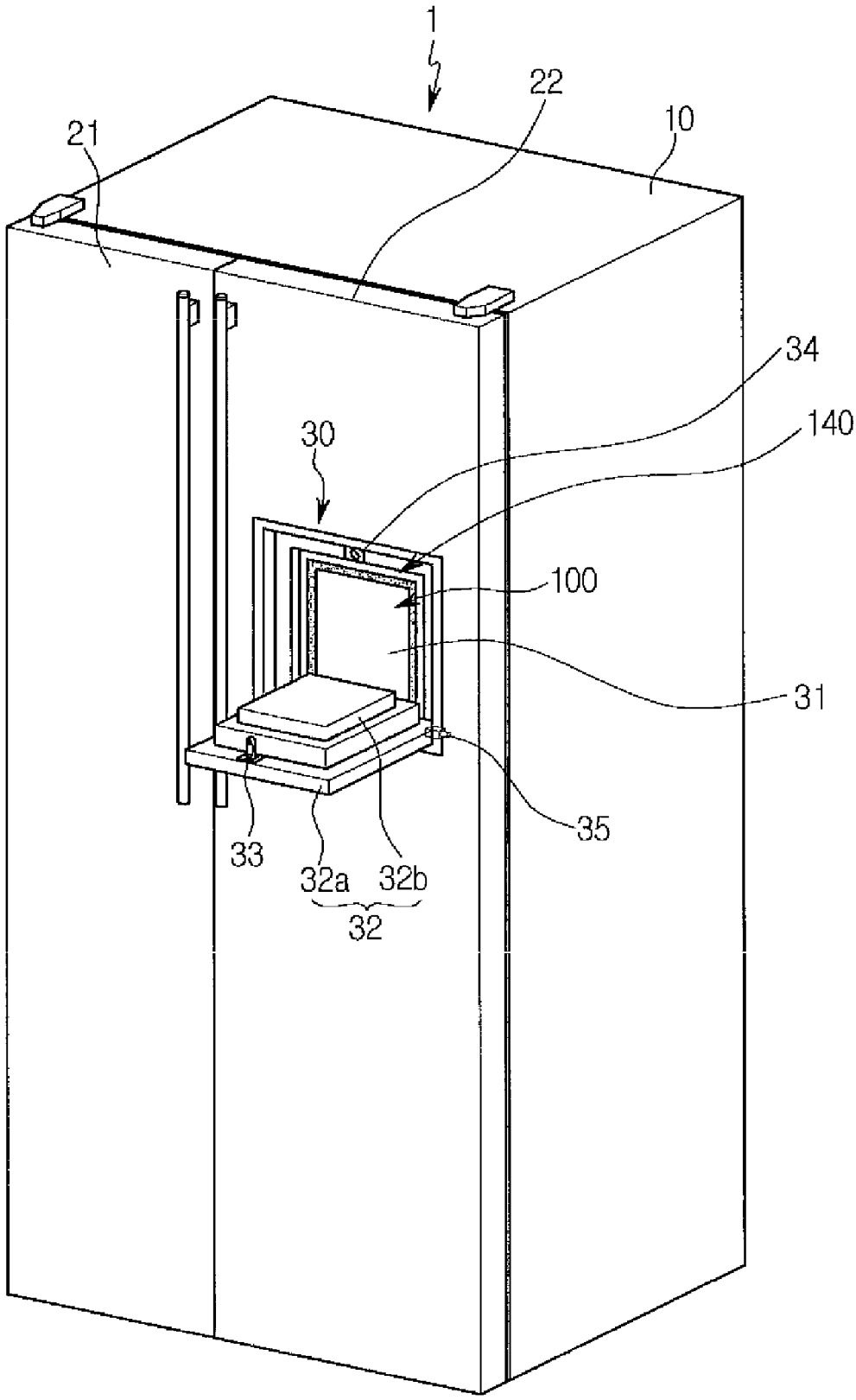
FIG. 1 is a perspective view illustrating a refrigerator including a home bar according to an embodiment.

FIG. 1 is a perspective view illustrating a refrigerator 1 including a home bar 30 according to an embodiment.

Referring to FIG. 1, the refrigerator 1 includes a body 10 storing cooling air, and a freezer door 21 and a refrigerator door 22, which are rotatably mounted on a front surface of the body 10. The freezer door 21 and the refrigerator door 22 selectively open and close a freezer compartment and a refrigerator compartment, respectively.

Hereinafter, a side-by-side refrigerator including a freezer compartment and a refrigerator compartment at right and left sides will be exemplarily explained. However, the present disclosure is not limited thereto, and may be applied to various refrigerators, such as a top mount refrigerator where a freezer compartment is provided over a refrigerator compartment and a bottom freezer refrigerator where a freezer compartment is provided under a refrigerator compartment.

The home bar 30 is provided at an about center portion of the refrigerator door 22 so that drink or food can be taken out. Although not shown, a home bar may be provided in the freezer door 21.

The home bar 30 includes a storage portion (not shown) for storing food and an opening 31 for taking the food out of the storage portion. The opening 31 is usually formed at a center portion of a front surface of the refrigerator door 22.

A home-bar frame 140 is provided around the opening 31 to form an edge portion of the opening 31.

The home bar 30 also includes a home-bar door 32 rotatably coupled to the opening 31. The home-bar door 32 includes a home-bar door frame 32*a* and a home-bar door liner 32*b*. The home-bar door frame 32*a* forms a front exterior of the home-bar door 32 when the home-bar door 32 is closed. The home-bar door liner 32*b* is provided at an inner side of the home-bar door frame 32*a* and forms a rear surface of the home-bar door 32 when the home-bar door 32 is closed. The home-bar door liner 32*b* is formed so as to have height difference from a rear surface of the home-bar door frame 32*a* and may have a cross-section smaller than that of the home-bar door frame 32*a*.

The home-bar door 32 is in contact with the home-bar frame 140 when it is closed. That is, the home-bar frame 140 has a shape corresponding to that of the home-bar door 32.

A hinge unit 35 is provided at both lower sides of the home-bar door 32, and the home-bar door 32 rotates around the hinge unit 35. The hinge unit 35 extends from one side of the home-bar door 32 to the inside of the refrigerator door 22.

The home-bar door 32 rotates around the hinge unit 35 so as to selectively shield the opening 31.

A hooking member 33 is provided in the home-bar door frame 32*a* such that the home-bar door 32 is coupled to the home-bar frame 140 when the home-bar door 32 is closed. The home-bar frame 140 includes a latch assembly 34, into which the hooking member 33 is inserted, provided at a portion corresponding to the hooking member 33.

That is, when the home-bar door 32 is closed, the hooking member 33 is inserted into the latch assembly 34 to maintain the closed state.

In order to open the home-bar door 32, an external upper portion of the home-bar door 32 may be pushed so that the hooking member 33 is separated from the latch assembly 34. Although not shown, a push portion may be provided on a front surface of the home-bar door frame 32*a* such that the hooking member 33 is separated from the latch assembly 34.

That is, the home-bar door 30 may be opened by pressing the push portion.

When the home-bar door 32 is closed, the home-bar door liner 32*b* is inserted into and brought into contact with an inner surface of the home-bar frame 140. Here, the front surface of the home-bar door frame 32*a* is on the same plane as the refrigerator door 22.

A gasket 100 is provided in the home bar 30 so as to prevent cooling air inside the body 10 from leaking through the home bar 30. The gasket 100 may be provided at an edge of the home-bar frame 140, that is, an inner surface of the home-bar frame 140. The gasket 100 will be described later in more detail.

Figure 2:
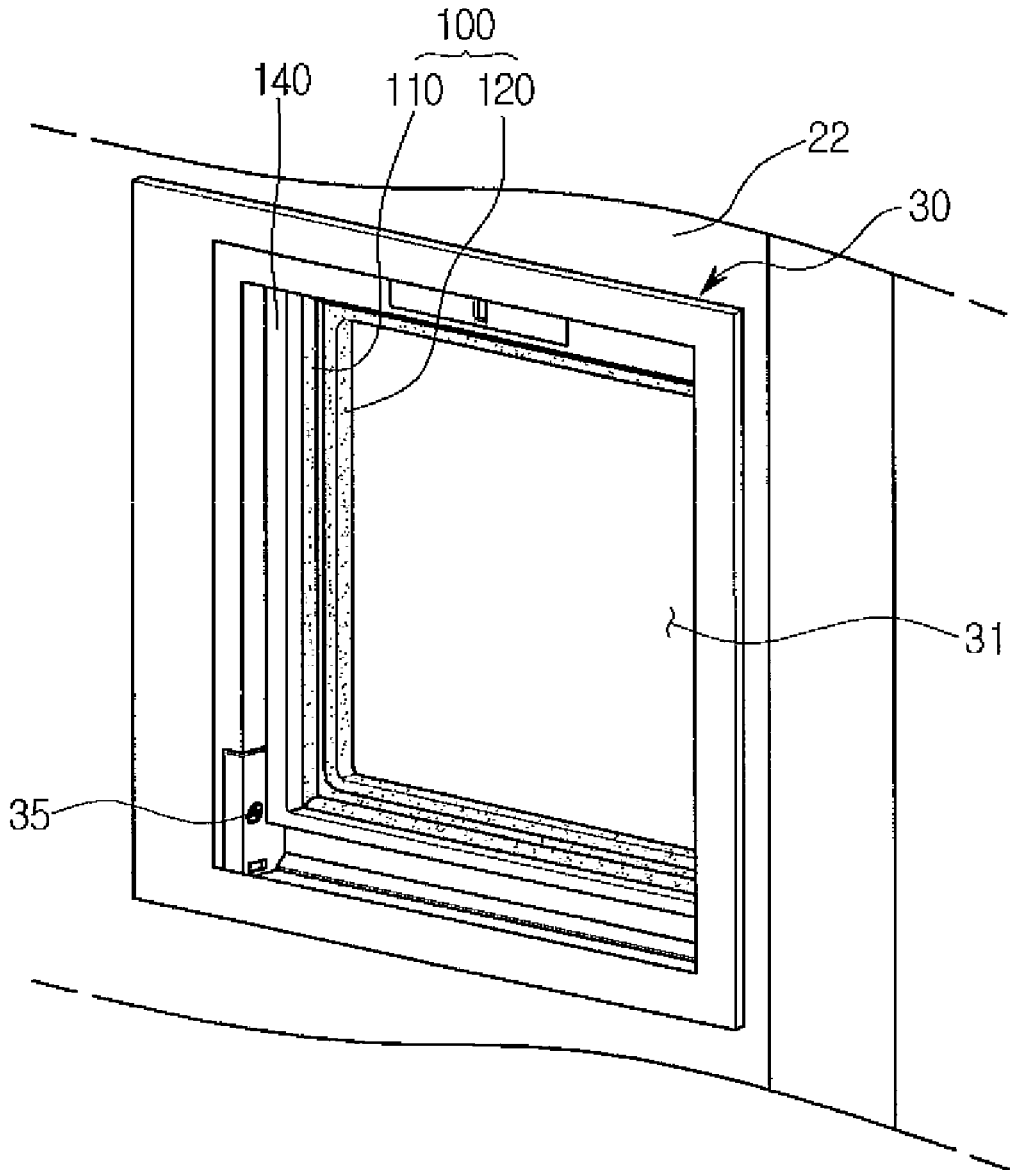
FIG. 2 is a perspective view illustrating an external structure of a home bar of a refrigerator according to an embodiment.
Figure 3:
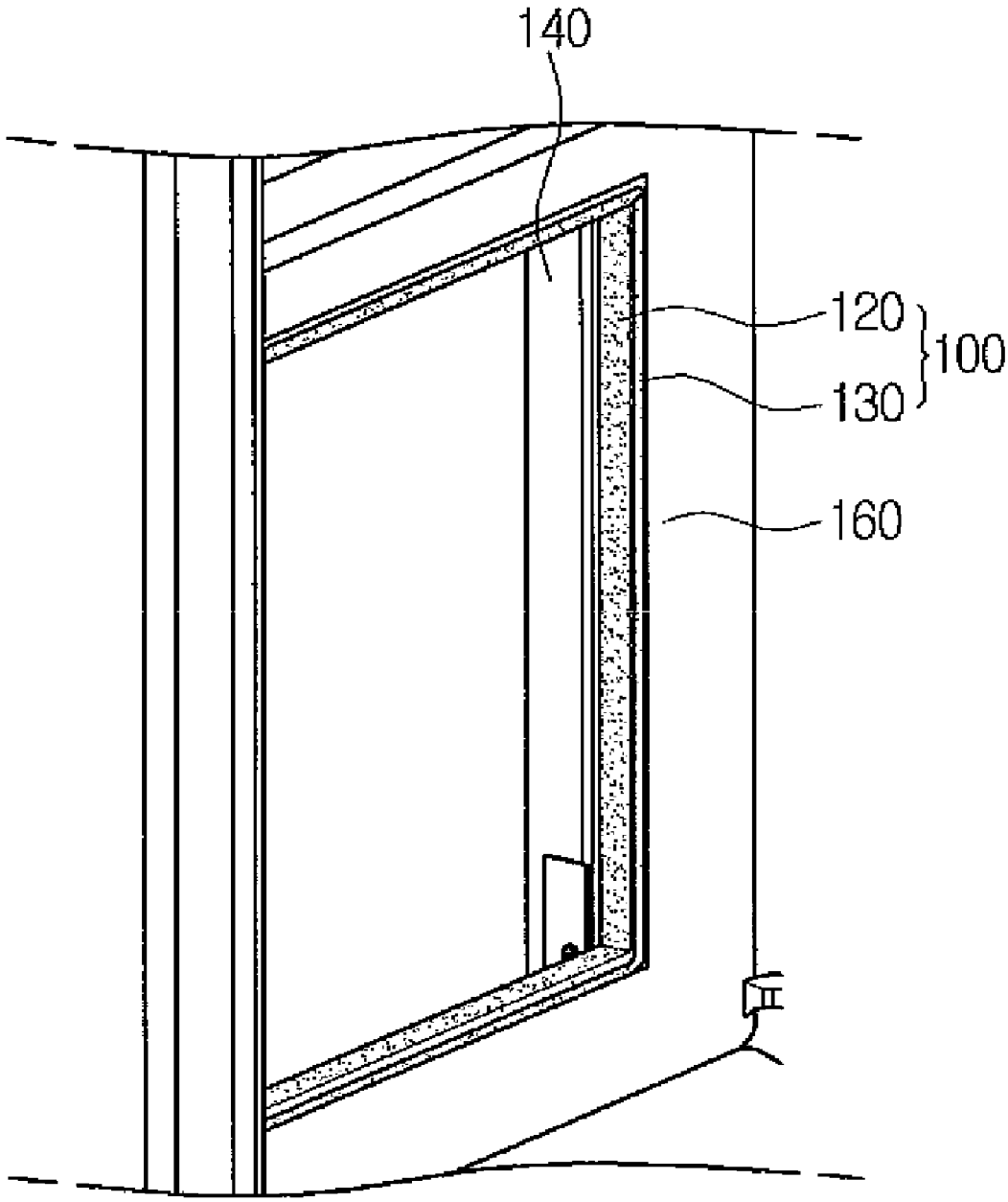
FIG. 3 is a perspective view illustrating an internal structure of a home bar of a refrigerator according to an embodiment.

FIG. 2 is a perspective view illustrating an external structure of a home bar of a refrigerator according to an embodiment, and FIG. 3 is a perspective view illustrating an internal structure of a home bar of a refrigerator according to an embodiment.

Referring to FIGS. 2 and 3, the home bar 30 includes the home-bar frame 140 that forms an exterior of the opening 31. The home-bar frame 140 forms an edge of the opening 31.

Specifically, the home-bar frame 140 has a shape corresponding to an inner surface of the home-bar door 32 such that the home-bar door 32 can shield the opening 31. That is, the home-bar frame 140 has a shape corresponding to the home-bar door frame 32*a* and the home-bar door liner 32*b*.

Therefore, the home-bar frame 140 may have height differences from the outside of the home bar 30 in an inward direction.

The gasket 100 is provided in the home-bar frame 140 and is in contact with the home-bar door 30 when the home-bar door 30 is closed. Here, the gasket 100 may be formed of rubber, silicon, soft synthetic resin, or the like.

In detail, the gasket 100 includes an outer portion 110 surrounding a front surface of the home-bar frame 140, an inner portion 130 surrounding a rear surface of the home-bar frame 140, and a connecting portion 120 connecting the outer portion 110 with the inner portion 130.

In more detail, the outer portion 110 is provided on a front surface of the home-bar frame 140, with which the home-bar door frame 32*a* is in contact when the home-bar door 32 is closed. The outer portion 110 has an elastic structure such that the home-bar door 32 is thoroughly brought into contact with the home-bar frame 140.

The connecting portion 120 is provided to be in contact with an inner surface of the home-bar frame 140. The inner portion 130 is inserted between the home-bar frame 140 and a door liner 160 forming an inner surface of the refrigerator door 22.

Here, the inner portion 130 shields a gap generated between the home-bar frame 140 and the door liner 160 to prevent cooling air inside a refrigerator compartment from leaking.

The gasket 100 may extend from the connecting portion 120 to the inner portion 130, and the outer portion 110 may be coupled to the connecting portion 120 at a predetermined portion. This will be described later in more detail.

Figure 4:
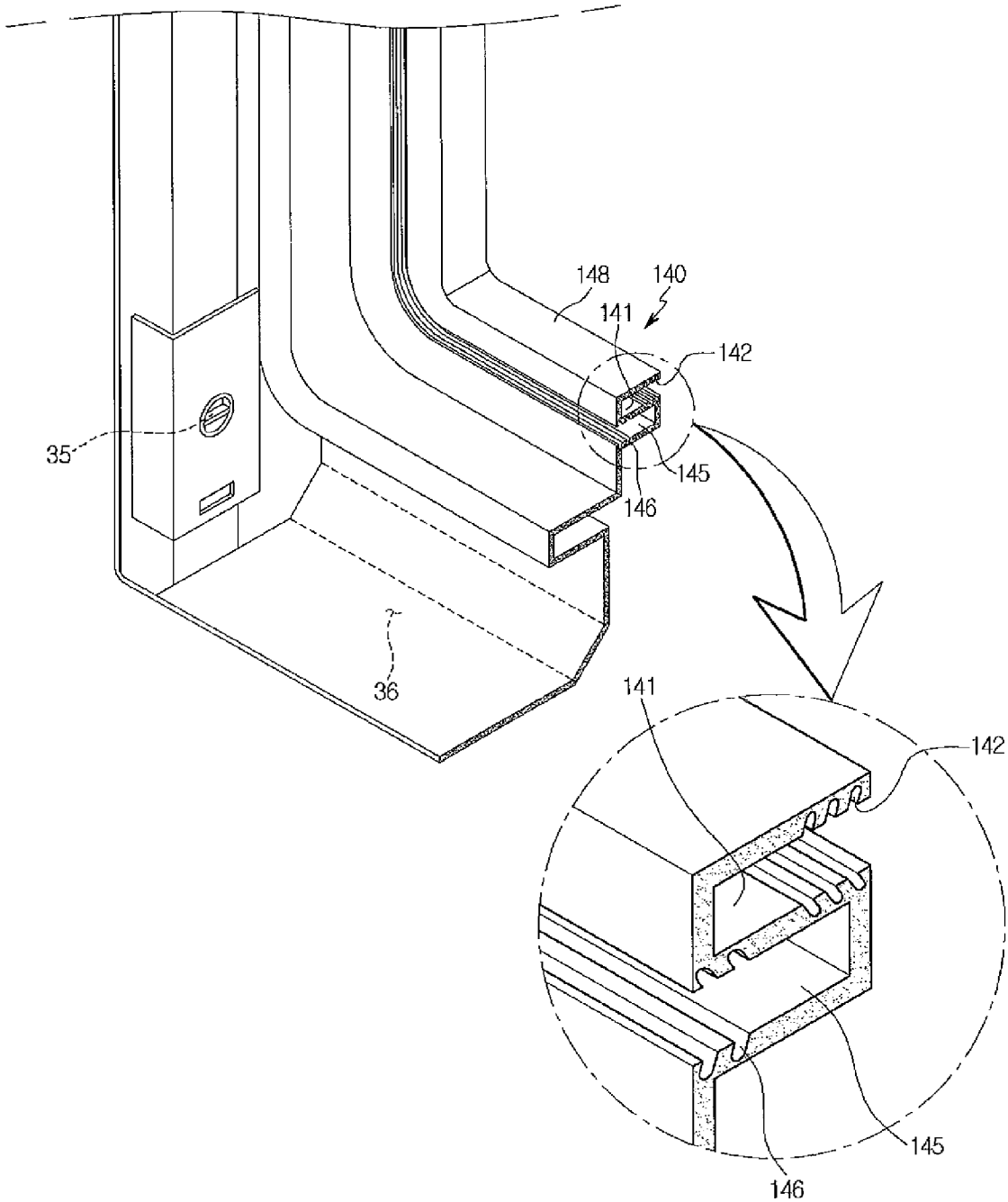
FIG. 4 is a cross-sectional view illustrating a home-bar frame of a home bar of a refrigerator according to an embodiment.

FIG. 4 is a cross-sectional view illustrating a home-bar frame of a home bar of a refrigerator according to an embodiment.

Referring to FIG. 4, the home-bar frame 140 includes the hinge unit 35, and the home-bar door 32 rotates around the hinge unit 35. The home-bar door 32 is rotatably disposed in a rotation space 36, which is formed at one side of the hinge unit 35.

The home-bar frame 140 has a shape corresponding to that of the home-bar door 32, and has height differences from the outside of the home-bar 30 in an inward direction.

In detail, the home-bar frame 140 includes an inner insert portion 141 into which the inner portion 130 of the gasket 100 is inserted, an outer insert portion 145 into which the outer portion 110 is inserted, and an inner surface 148 with which the connecting portion 120 is brought into contact.

Here, since the home-bar frame 140 forms rectangular shape along an edge of the opening 31, the inner insert portion 141, the outer insert portion 145, and the inner surface 148 are formed at four sides of the home-bar frame 140.

The inner insert portion 141 is recessed to a predetermined depth from a rear side of the home-bar frame 140, and the outer insert portion 145 is recessed to a predetermined depth from a front side of the home-bar frame 140. The inner insert portion 141 and the outer insert portion 145 have different heights.

An inner groove 142 and an outer groove 146 are formed in the inner insert portion 141 and the outer insert portion 145, respectively. The inner portion 130 and the outer portion 110 are inserted and fixed into the inner groove 142 and the outer groove 146.

The gasket 100 may be inserted and fixed into the inner groove 142 and the outer groove 146.

Here, the inner groove 142 is inclined in a rearward direction of the home-bar frame 140, and the outer groove 146 is inclined in a frontward direction, such that the gasket 100 cannot be easily separated from the inner groove 142 and the outer groove 146.

Figure 5:
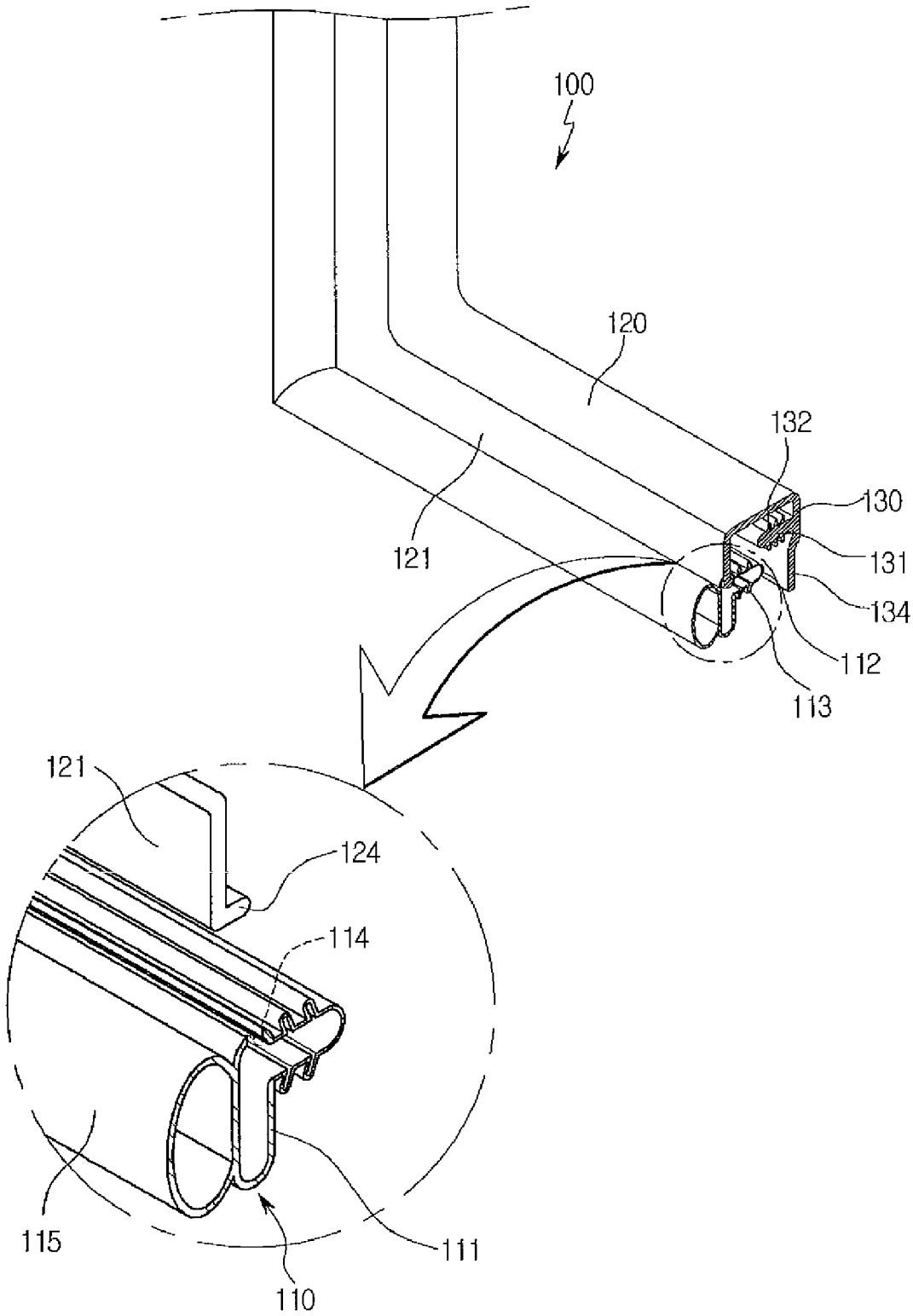
FIG. 5 is a cross-sectional view illustrating a gasket of a home bar of a refrigerator according to an embodiment.
Figure 6:
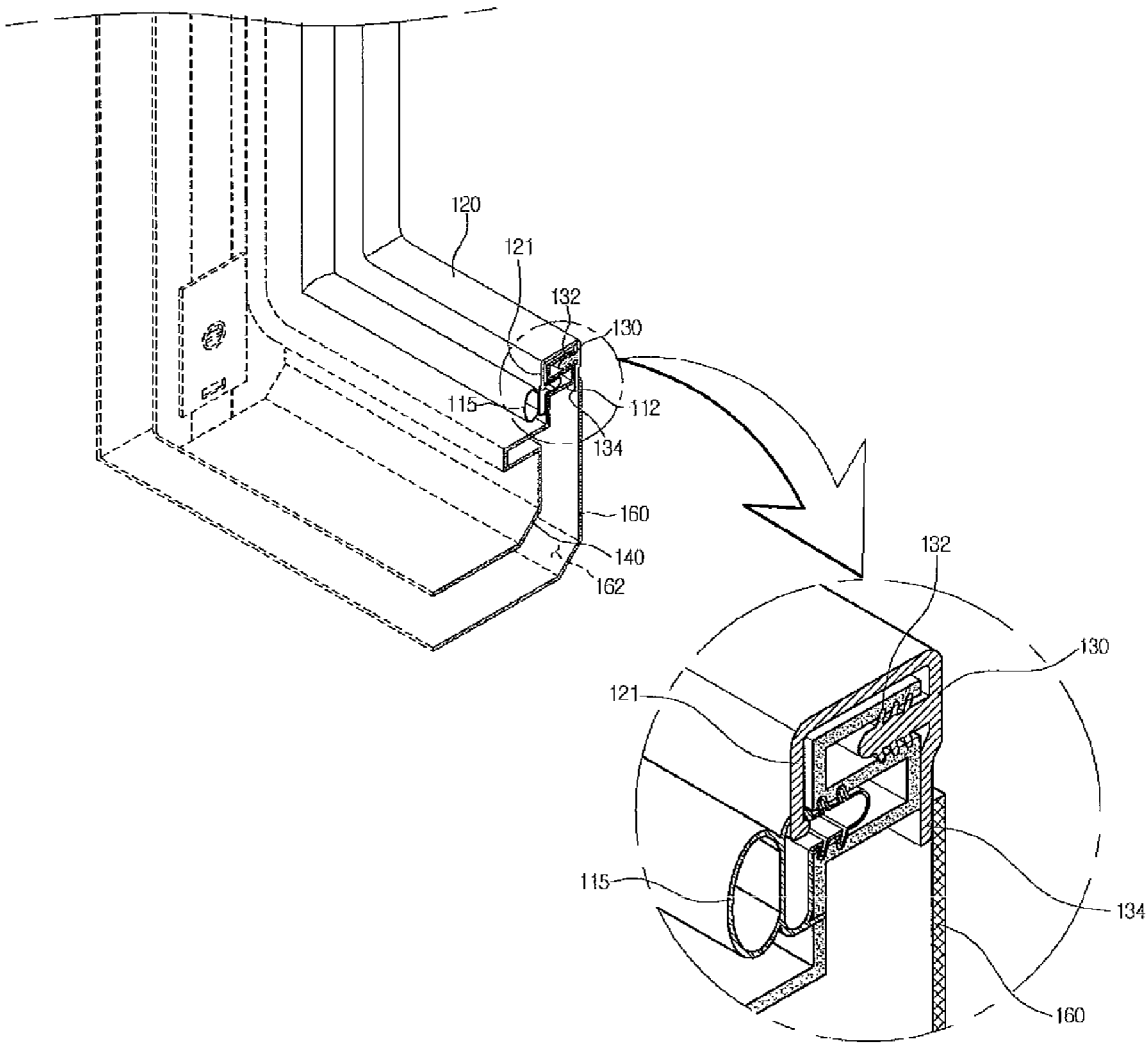
FIG. 6 is a cross-sectional view illustrating a gasket coupled to a home-bar frame of a home bar of a refrigerator according to an embodiment.

FIG. 5 is a cross-sectional view illustrating a gasket of a home bar of a refrigerator according to an embodiment, and FIG. 6 is a cross-sectional view illustrating a gasket coupled to a home-bar frame of a home bar of a refrigerator according to an embodiment.

Referring to FIG. 5, the gasket 100 includes the outer portion 110 coupled to a front surface of the home-bar frame 140, the inner portion 130 coupled to a rear surface of the home-bar frame 140, and the connecting portion 120 that is brought into contact with an inner surface of the home-bar frame 140.

In detail, the outer portion 110 includes a hooking portion 111 and a pocket 115. The hooking portion 111 is coupled to the connecting portion 120, and the pocket 115 brings the home-bar door 32 into contact with the home-bar frame 140 when the home-bar door 32 is closed. Here, the pocket 115 may be formed of an elastic material so as to easily shield an internal storage portion of the home bar 30.

An outer coupling portion 112 is provided at he hooking portion 111 and is inserted into the outer insert portion 145 of the home-bar frame 140. An outer protrusion 113 is formed at the outer coupling portion 112 to be inserted into the outer groove 146.

The outer coupling portion 112 extends (protrudes) from one side of the hooking portion 111 in a rearward direction. The outer protrusion 113 is inclined in a frontward direction from an outer side of the outer coupling portion 112.

That is, the outer protrusion 132 may be inclined in a direction corresponding to the outer groove 146. The outer protrusion 132 may be elastic.

The inner portion 130 extends from the connecting portion 120 in a downward direction. Here, the inner portion 130 may be formed integrally with the connecting portion 120. A contact portion 134 is formed under the inner portion 130 and is in contact with an inner side of a refrigerator door liner (not shown).

An inner coupling portion 131 is provided at the inner portion 130 and is inserted into the inner insert portion 141 of the home-bar frame 140. An inner protrusion 132 is formed at the inner coupling portion 131 and is inserted into the inner groove 142.

The inner coupling portion 131 extends (protrudes) from one side of the inner portion 130 in a frontward direction. The inner protrusion 132 is inclined in a rearward direction from an outer side of the inner coupling portion 131.

That is, the inner protrusion 132 may be inclined in a direction corresponding to the inner groove 142. The inner protrusion 132 may be elastic.

A coupling portion 121 extends from one side of the connecting portion 120 in a downward direction to be coupled to the hooking portion 111.

An insert hole 114, into which one end of the coupling portion 121 is inserted, is formed in the hooking portion 111. The insert hole 114 may be elongated in a length direction of the hooking portion 111.

A hook end 124 extends from a lower portion of the coupling portion 121 in a rearward direction. The hook end 124 is in contact with an inner surface of the hooking portion 111 when the coupling portion 121 is inserted into the insert hole 114.

The coupling portion 121 is inserted into the insert hole 114 in a downward direction so as to couple the hooking portion 111 to the coupling portion 121. Here, in order to easily insert the coupling portion 121 into the insert hole 114, the insert hole 114 can be widened by pulling the hooking portion 111 in both horizontal directions.

In this case, the hooking portion 111 may be formed of rubber with a predetermined elastic force. After the coupling portion 121 is completely inserted into the insert hole 114, the hooking portion 111 may return to its original state by a restoring force.

The coupling portion 121 has a width smaller than that of the insert hole 114. Therefore, the coupling portion 121 may be in contact with the hooking portion 111.

Since the hooking portion 111 and the coupling portion 121 are formed of elastic rubber, a mutually pressing force is applied to the coupling portion 121 and the hooking portion 111 when the coupling portion 121 is coupled to the hooking portion 111.

Since the hook end 124 protrudes in a rearward direction, when the coupling portion 121 is inserted into the hooking portion 111, a pressing force is applied between the coupling portion 121 and the hooking portion 111 in upward and downward directions. Therefore, the coupling portion 121 is not easily separated from the hooking portion 111.

As a result, when the coupling between the outer portion 110 and the coupling portion 121 is finished, the gasket 100 is integrally formed, and then the gasket 100 may be mounted on an outer side of the home-bar frame 140.

Figure 7:
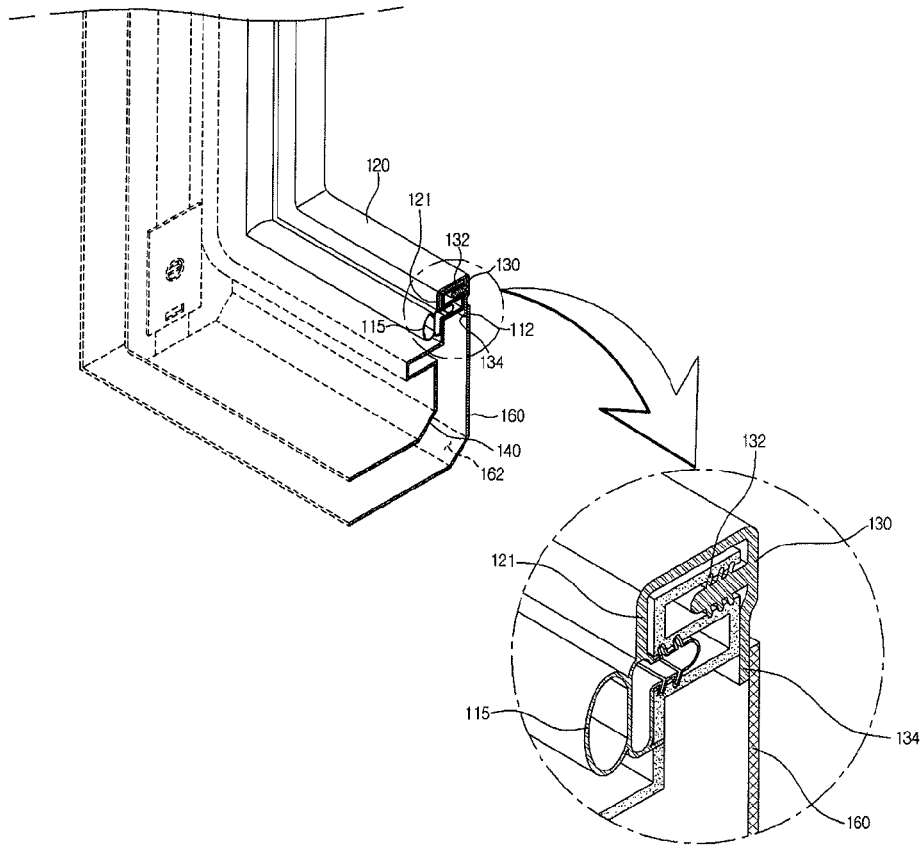
FIG. 7 is a cross-sectional view illustrating a gasket coupled to a home-bar frame of a home bar of a refrigerator according to another embodiment

Alternatively, as shown in FIG. 7, the outer portion 110 may extend from the connecting portion 120 and may be formed integrally with the connecting portion 120. That is, the outer portion 110, the connecting portion 120, and the inner portion 130 may be integrally formed.

Unlike the embodiment illustrated in FIG. 5, the outer portion 110 and the connecting portion 120 may be integrally formed and a lower end of the connecting portion 120 may be coupled to the inner portion 130. That is, at least one of the outer portion 110 and the inner portion 130 may be coupled to the connecting portion 120.

Therefore, this embodiment can reduce processes of assembling and pressing the gasket 100 at inner and outer sides of the home-bar frame 140. In addition, the gasket 100, which is integrally formed, is coupled to the home-bar frame 140, thereby simplifying the assembly process.

In addition, costs for installing the gasket 100 into the home-bar 30 can be remarkably reduced.

Furthermore, since the inner surface 148 of the home-bar frame 140 may be also sealed by the connecting portion 120 of the gasket 100, insulation between inside and outside the home bar 30 can be improved.

Hereinafter, assembly structure and process of the gasket 100 and the home-bar frame 140 will be described.

The outer coupling portion 112 inserted into the outer insert portion 145 of the home-bar frame 140 is provided at the hooking portion 111, and the outer protrusion 113 inserted into the outer groove 146 is formed at the outer coupling portion 112.

The inner coupling portion 131 inserted into the inner insert portion 141 of the home-bar frame 140 is provided at the inner portion 130, and the inner protrusion 132 inserted into the inner groove 142 is formed at the inner coupling portion 131.

The outer protrusion 113 and the outer protrusion 132 are inclined in a predetermined direction in order to prevent them from being separated from the outer groove 146 and the inner groove 142.

In detail, the outer protrusion 113 is inclined in a frontward direction, such that the outer portion 110 is not separated from the outer insert portion 145 in a frontward direction. The inner protrusion 132 is inclined in a rearward direction, such that the inner portion 130 is not separated from the inner insert portion 141 in a rearward direction.

Therefore, when the coupling between the outer and inner portions 110 and 130 and the home-bar frame 140 is finished, the outer portion 110 and the inner portion 130 are not separated respectively in frontward and rearward directions by locking between the outer and inner grooves 146 and 142 and the outer and inner protrusions 113 and 132.

Next, a coupling process of the gasket 100 and the home-bar frame 140 will be described.

As described above, when the coupling portion 121 of the gasket 100 is coupled to the outer portion 110, the gasket 100 is formed as one component.

Then, the outer portion 110 is inserted into the outer insert portion 145 of the home-bar frame 140 in a rearward direction, as illustrated in FIG. 6.

In this case, the outer protrusion 113 is inclined in a frontward direction, and thus is brought into contact with the outer coupling portion 112 during the insert process. When the outer protrusion 113 is positioned in the outer groove 146, the outer protrusion 113 is inserted into the outer groove 146 by a restoring force.

After the outer portion 110 is inserted into the outer insert portion 145, the inner portion 130 is inserted into the inner insert portion 141 through a process similar to the assembly process of the outer portion 110.

As a result, when the outer portion 110 and the inner portion 130 are inserted into the outer and inner insert portions 145 and 141, since the protrusions 113 and 132 are inclined in frontward and rearward directions, respectively, the outer portion 110 and the inner portion 130 are not easily separated from the home-bar frame 140 by the protrusions 113 and 132.

When the outer portion 110 and the inner portion 130 are coupled to the home-bar frame 140, the connecting portion 120 is in contact with the inner surface 148. Therefore, the inner surface 148 is shielded by the connecting portion 120 and thus is not exposed outside, thereby preventing cooling air in the storage portion from leaking.

When the gasket 100 is coupled to the home-bar frame 140, the door liner 160 forming a rear surface of the refrigerator door 22 is seated on the inner portion 130.

Therefore, the pressed portion 134 of the inner portion 130 is brought into contact with the home-bar frame 140 at one side and is brought into contact with the door liner 160 at other side.

That is, the pressed portion 134 of the inner portion 130 is interposed between the home-bar frame 140 and the door liner 160 and is continuously in contact with them.

An insulating space 162 is formed between the home-bar frame 140 and the door liner 160. The insulating space 162 is filled with an insulating material for insulation between inside and outside of the home-bar 30.

According to a home bar of a refrigerator according to the embodiments, a gasket coupled to a home-bar frame can be integrally formed, thereby simplifying an assembly process of the gasket and reducing costs.

In addition, the gasket (connecting portion) can seal an inner surface as well as front and rear surfaces of the home-bar frame, thereby improving insulation between inside and outside of the refrigerator and preventing cooling air in the home bar from leaking.

Any reference in this specification to "one embodiment," an embodiment, "exemplary embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with others of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A home bar for a refrigerator, comprising:

an opening on a refrigerator door;

a home-bar frame forming an edge portion of the opening, the home-bar frame including a first groove depressed in a first direction thereof and a second groove depressed in a second direction thereof;

a home-bar door rotatably coupled to one end of the home-bar frame; and a gasket coupled to the home-bar frame, the gasket including a first portion coupled to the first groove and a second portion coupled to the second groove, wherein the first direction and the second direction define opposed directions.

2. The home bar according to claim 1, wherein the gasket is coupled to the home-bar frame at each of front and rear sides of the home-bar frame.

3. The home bar according to claim 1, wherein each of the first and second portions comprises a protrusion inserted into the home-bar frame.

4. The home bar according to claim 3, wherein each of the protrusions are inclined from an outer surface of the corresponding first and second portions.

5. The home bar according to claim 1, wherein the gasket surrounds an inner surface of the home-bar frame.

6. A home bar for a refrigerator, comprising:

a body storing cooling air;

a refrigerator door rotatably coupled to the body;

a home-bar frame provided in the refrigerator door to form an opening;

a gasket coupled to the home-bar frame to prevent cooling air leakage from the body; and a home-bar door selectively shielding the opening and being in contact with the gasket, wherein the gasket comprises:

an outer portion provided on a front surface of the home-bar frame;

an inner portion provided on a rear surface of the home-bar frame; and a connecting portion brought into contact with an inner surface of the home-bar frame.

7. The home bar according to claim 6, wherein the inner portion is formed integrally with the connecting portion and the outer portion is coupled to the connecting portion.

8. The home bar according to claim 7, wherein an insert hole is disposed at the outer portion and one end of the connecting portion is inserted into the insert hole.

9. The home bar according to claim 6, wherein an inner coupling portion is disposed in the inner portion and an inner insert portion is disposed in the home-bar frame, the inner coupling portion being coupled to the home-bar frame and being inserted into the inner insert portion.

10. The home bar according to claim 9, wherein the inner coupling portion extends from one side of the inner portion in a frontward direction and the inner insert portion is recessed from the rear side of the home-bar frame in a frontward direction.

11. The home bar according to claim 9, wherein an inner groove for coupling of the inner coupling portion is disposed in the inner insert portion and an inner protrusion is disposed in the inner coupling portion, the inner protrusion being inserted into the inner groove.

12. The home bar according to claim 11, wherein the inner groove is inclined in a rearward direction and the inner protrusion is inclined from the outside of the inner coupling portion in a rearward direction.

13. The home bar according to claim 6, wherein an outer coupling portion is disposed in the outer portion and an outer insert portion is disposed in the home-bar frame, the outer coupling portion being coupled to the home-bar frame and being inserted into the outer insert portion.

14. The home bar according to claim 13, wherein the outer coupling portion extends from one side of the outer portion in a rearward direction and the outer insert portion is recessed from the front side of the home-bar frame in a rearward direction.

15. The home bar according to claim 13, wherein an outer groove for coupling of the outer coupling portion is disposed in the outer insert portion and an outer protrusion is disposed in the outer coupling portion, the outer protrusion being inserted into the outer groove.

16. The home bar according to claim 15, wherein the outer groove is inclined in a frontward direction and the outer protrusion is inclined from an outside of the outer coupling portion in a frontward direction.

17. The home bar according to claim 8, wherein the outer portion and the inner portion are formed integrally with the connecting portion.

18. A home bar for a refrigerator, comprising:

an opening on a refrigerator door;

a home-bar frame forming an edge portion of the opening;

a home-bar door selectively shielding the opening; and a gasket comprising a plurality of coupling portions coupled to the home-bar frame, wherein a plurality of insert portions are disposed in the home-bar frame, the coupling portions are inserted into the insert portions at front and rear sides, and wherein the insert portions comprise:

an inner insert portion recessed in a frontward direction of the home-bar frame; and an outer insert portion recessed in a rearward direction of the home-bar frame.

19. The home bar according to claim 18, wherein the coupling portions comprise:

an inner coupling portion inserted into the inner insert portion; and an outer coupling portion inserted into the outer insert portion.

20. The home bar according to claim 18, wherein the gasket further comprises a connecting portion brought into contact with an inner surface of the home-bar frame and the connecting portion is formed integrally with the coupling portions.

21. An assembly method of a home bar for a refrigerator, the method comprising:

coupling a connecting portion of a gasket, which is in contact with an inner surface of a home-bar frame, to an outer portion of the gasket coupled to a front side of the home-bar frame;

inserting the outer portion into an outer insert portion of the home-bar frame;

inserting an inner portion of the gasket, which is coupled to a rear side of the home-bar frame, into an inner insert portion of the home-bar frame; and seating a refrigerator door liner on one side of the inner portion.

22. The method according to claim 21, wherein the inserting of the outer portion into the outer insert portion comprises inserting an outer protrusion disposed in the outer portion into an outer groove of the outer insert portion.

23. The method according to claim 21, wherein the inserting of the inner portion into the inner insert portion comprises inserting an inner protrusion disposed in the inner portion into an inner groove of the inner insert portion.

* * * * *